US008416044B2

(12) United States Patent
Saka et al.

(10) Patent No.: US 8,416,044 B2
(45) Date of Patent: Apr. 9, 2013

(54) REACTOR AND METHOD OF PRODUCING THE REACTOR

(75) Inventors: Kenji Saka, Oobu (JP); Takashi Yanbe, Sendai (JP)

(73) Assignees: Denso Corporation, Kariya (JP); NEC Tokin Corporation, Sendai (JP)

( * ) Notice: Subject to any disclaimer, the term of this patent is extended or adjusted under 35 U.S.C. 154(b) by 26 days.

(21) Appl. No.: 12/619,085

(22) Filed: Nov. 16, 2009

(65) Prior Publication Data

US 2010/0123541 A1 May 20, 2010

(30) Foreign Application Priority Data

Nov. 14, 2008 (JP) ..... 2008-291746

(51) Int. Cl.
*H01F 27/02* (2006.01)
*H01F 17/04* (2006.01)
*H01F 27/24* (2006.01)

(52) U.S. Cl. ..... 336/90; 336/82; 336/83; 336/92; 336/96; 336/221; 336/233

(58) Field of Classification Search ..... 336/82, 336/83, 90, 213, 221, 233, 92, 96
See application file for complete search history.

(56) References Cited

U.S. PATENT DOCUMENTS

| | | | | |
|---|---|---|---|---|
| 1,855,562 | A * | 4/1932 | Swinne | 252/62.55 |
| 2,330,590 | A * | 9/1943 | Kaschke | 252/62.54 |
| 6,198,373 | B1 | 3/2001 | Ogawa et al. | |
| 6,888,435 | B2 * | 5/2005 | Inoue et al. | 336/83 |
| 2005/0007232 | A1 * | 1/2005 | Ono et al. | 336/213 |
| 2005/0012581 | A1 | 1/2005 | Ono et al. | |
| 2008/0164051 | A1 * | 7/2008 | Lee et al. | 174/131 A |

FOREIGN PATENT DOCUMENTS

| | | | |
|---|---|---|---|
| EP | 1710815 | A1 * | 10/2006 |
| JP | 56-157007 | | 12/1981 |
| JP | 01-283913 | | 11/1989 |
| JP | 11-067521 | | 3/1999 |
| JP | 2000156117 | A * | 6/2000 |
| JP | 2001-068361 | | 3/2001 |
| JP | 2003-317547 | | 11/2003 |
| JP | 2006-004957 | | 1/2006 |
| JP | 2008-228434 | | 9/2008 |

OTHER PUBLICATIONS

Japanese Notification of Reasons for Rejection for corresponding Japanese Application No. 2008-291746, dated May 15, 2012 (with translation).

* cited by examiner

*Primary Examiner* — Mohamad Musleh
*Assistant Examiner* — Tsz Chan
(74) *Attorney, Agent, or Firm* — Nixon & Vanderhye P.C.

(57) ABSTRACT

A reactor is composed of a coil and a core placed in the inside area and outer peripheral area of the coil in a container. The core is composed of magnetic powder, non-magnetic powder, and resin. The non-magnetic powder is composed of main component powder and low elastic modulus powder. The main component powder as a main component of the non-magnetic powder is made of one or more kinds of powder of a heat conductivity which is larger than that of the resin. The low elastic modulus powder is made of one or more kinds of powder of an elastic modulus which is smaller than that of the powder forming the main component powder.

6 Claims, 5 Drawing Sheets

REACTOR AND METHOD OF PRODUCING THE REACTOR

CROSS-REFERENCE TO RELATED APPLICATION

This application is related to and claims priority from Japanese Patent Application No. 2008-291746 filed on Nov. 14, 2008, the contents of which are hereby incorporated by reference.

BACKGROUND OF THE INVENTION

1. Field of the Invention

The present invention relates to a reactor comprised of a coil and a core placed in a container, and a method of producing the reactor for use in an electric power conversion device and the like.

2. Description of the Related Art

There is a known conventional reactor comprised of a coil and a core placed in a container. Japanese patent laid open publication No. JP 2006-004957 has disclosed such a conventional reactor comprised of a coil, a core placed in a container. The coil is spirally wound, and generates a magnetic flux when a current flows therein. The core is made of a resin mixture of magnetic powder and resin. The outer periphery side and the inner side of the coil in the container are filled with the resin mixture, in other words, the coil is embedded in the resin mixture placed in the container.

In the method of producing the reactor, at first, a conductive wire is spirally wound in a concentric configuration in order to make the coil.

Next, the coil is placed in the container, and then filled with the resin mixture. Finally, the resin mixture is solidified to make the core in which the coil is embedded. This completes the method of producing the reactor.

However, the conventional reactor has a following drawback. Because the conductive wire is made of copper, that is, the coil is made of copper, the coil is thermally expanded when a current flows therein. The thermal expansion of the coil generates pressure. The stress generated in the coil is applied to the core formed around the coil. That is, an excess stress is applied to the core when the coil is thermally expanded. This often causes that the core breaks, and a crack is generated in the reactor. This makes it impossible to provide a predetermined magnitude of inductance of the reactor.

In general, a high elastic modulus of the core often causes a crack therein. This means that the magnetic powder in the resin mixture forming the core has a high elastic modulus. One possible countermeasure to decrease the elastic modulus of the core is to decrease the amount of magnetic powder in the resin mixture in the core. However, this can decrease the magnetic characteristics of the core, and thereby makes it difficult to generate a desired amount of magnetic flux.

SUMMARY OF THE INVENTION

It is an object of the present invention to provide a reactor composed of a coil and core, and method of producing the reactor capable of suppressing the core from breaking while maintaining its magnetic characteristics.

To achieve the above purposes, the present invention provides a reactor comprised of a coil, a core, and a container. The coil is composed of a spirally-wound conductive wire, and generates magnetic field when a current flows therein. The core is placed in an inside area and an outer peripheral area of the coil in the container in which the coil and the core are placed. The core is made of a magnetic-powder resin mixture composed of magnetic powder, non-magnetic powder, and resin. The non-magnetic powder is composed of main component powder and a low elastic modulus powder. The main component powder as a main component of the non-magnetic powder is made of one or more kinds of powder. The heat conductivity of the main component powder is larger than that of the resin. The low elastic modulus powder is made of one or more kinds of powder. An elastic modulus of the low elastic modulus powder is smaller than that of the main component powder.

In the reactor according to the present invention, the non-magnetic powder is made of the main component powder and the low elastic modulus powder. The main component powder is composed of one or more main component powders having a heat conductivity which is larger than that of the resin. The low elastic modulus powder is made of one or more kinds of powder having an elastic modulus which is smaller than that of the main component powder.

Using the non-magnetic powder composed of the low elastic modulus powder in addition to the main component powder in the core of the reactor can decrease the elastic modulus of the entire non-magnetic powder, and further decrease the elastic modulus of the entire core. This structure allows decreasing of the stress applied from the coil to the core in the reactor when a current flows in the coil. As a result, it is possible to provide the reactor capable of suppressing the core from damaging and breaking.

Further, the above structure of the reactor according to the present invention can decrease the elastic modulus of the entire core without decreasing the content of the magnetic powder in the core. It is thereby possible to maintain the magnetic characteristics of the reactor while suppressing the core from damaging and breaking.

Still further, because the non-magnetic powder contains the main component powder having a heat conductivity which is larger than that of the resin, it is possible for the reactor to adequately radiate heat energy. This can maintain the magnetic characteristics and radiation performance of the reactor.

As described above, according to the present invention, it is possible to provide the reactor capable of suppressing the core from damaging and breaking while maintaining the magnetic characteristics thereof.

In accordance with another aspect of the present invention, there is provided a method of producing the reactor described above. That is, the method produces the reactor comprised of a coil, a core, and a container, where the coil is composed of a wound conductive wire, the coil generates magnetic flux when a current flows in the coil, and the core is placed in the inside area and the outer peripheral area of the coil. In particular, the method has steps of: (a) spirally winding a conductive wire, and placing the coil in the container; (b) filling, into the inside area and the outer peripheral area of the coil placed in the container, a magnetic-powder resin mixture; and (c) hardening the magnetic-powder resin mixture placed in the container. The method uses the magnetic-powder resin mixture composed of magnetic powder, non-magnetic powder, and resin. The non-magnetic powder is composed of main component powder and a low elastic modulus powder. The main component powder, as a main component of the non-magnetic powder, is made of one or more kinds of powder of a heat conductivity which is larger than that of the resin. The low elastic modulus powder is made of one or more kinds of powder of an elastic modulus which is smaller than that of the main component powder.

The method according to the present invention provides the reactor capable of decreasing the elastic modulus of the entire non-magnetic powder without decreasing the content of the magnetic powder contained in the core. As a result, the method provides the reactor capable of adequately decreasing the elastic modulus of the entire core. It is thereby possible to decrease the stress to be applied to the core from the coil when the coil is thermally expanded during a current flowing in the coil. In other words, the method according to the present invention can produce the reactor capable of suppressing the core from damaging and breaking while maintaining the magnetic characteristics of the entire reactor.

BRIEF DESCRIPTION OF THE DRAWINGS

A preferred, non-limiting embodiment of the present invention will be described by way of example with reference to the accompanying drawings, in which.

DETAILED DESCRIPTION OF THE PREFERRED EMBODIMENTS

Figure 1:
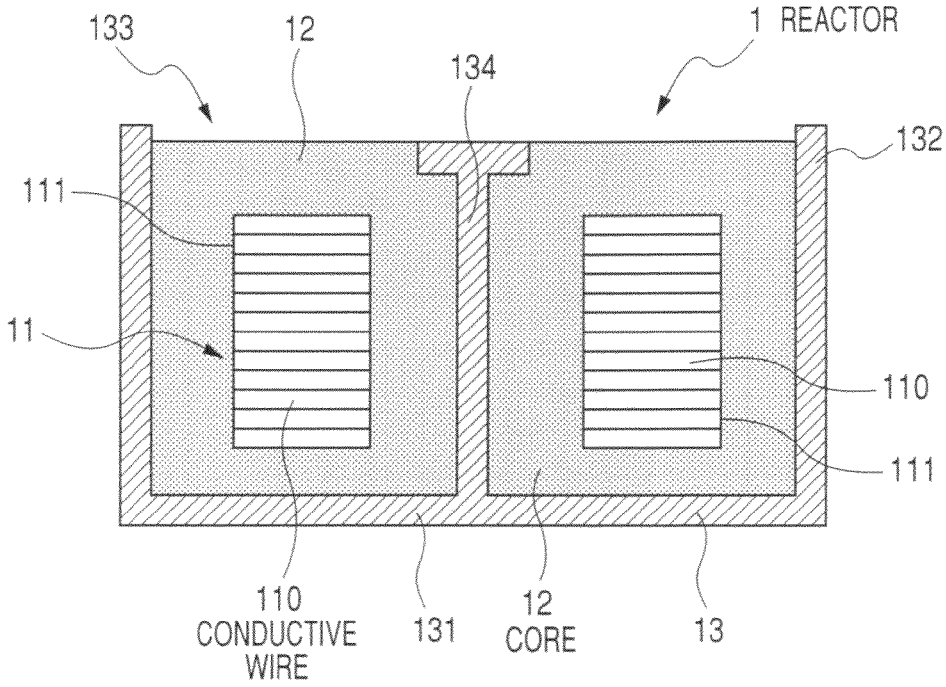
FIG. 1 is a vertical cross-sectional view showing a reactor according to a first embodiment of the present invention.

Hereinafter, various embodiments of the present invention will be described with reference to the accompanying drawings. In the following description of the various embodiments, like reference characters or numerals designate like or equivalent component parts throughout the several diagrams.

First Embodiment

A description will be given of a reactor according to a first embodiment of the present invention with reference to FIG. 1 to FIG. 4A, FIG. 4B, and FIG. 4C, and FIG. 7.

Figure 2:
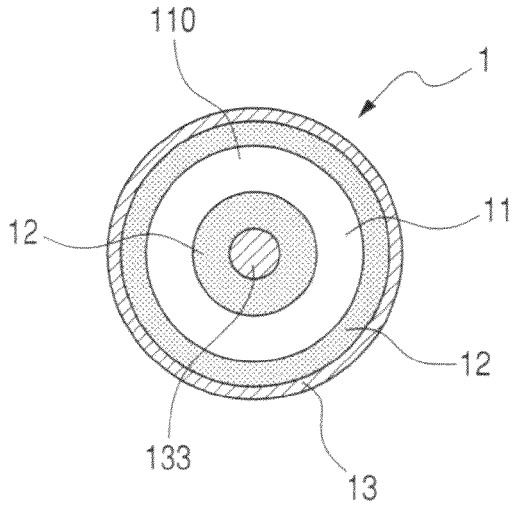
FIG. 2 is a top view of the reactor according to the first embodiment of the present invention shown in FIG. 1.

FIG. 1 is a vertical cross-sectional view showing the reactor 1 according to the first embodiment of the present invention. FIG. 2 is a top view of the reactor 1 according to the first embodiment shown in FIG. 1.

As shown in FIG. 1 and FIG. 2, the reactor 1 is comprised of a coil 11 and a core 12. The coil 11 is made by winding a flat type conductive wire 110. The coil 11 generates magnetic flux when a current flows therein. The core 12 is placed in an inside area and an outside area of the coil 11 in a container (or a case) 13.

Figure 3:
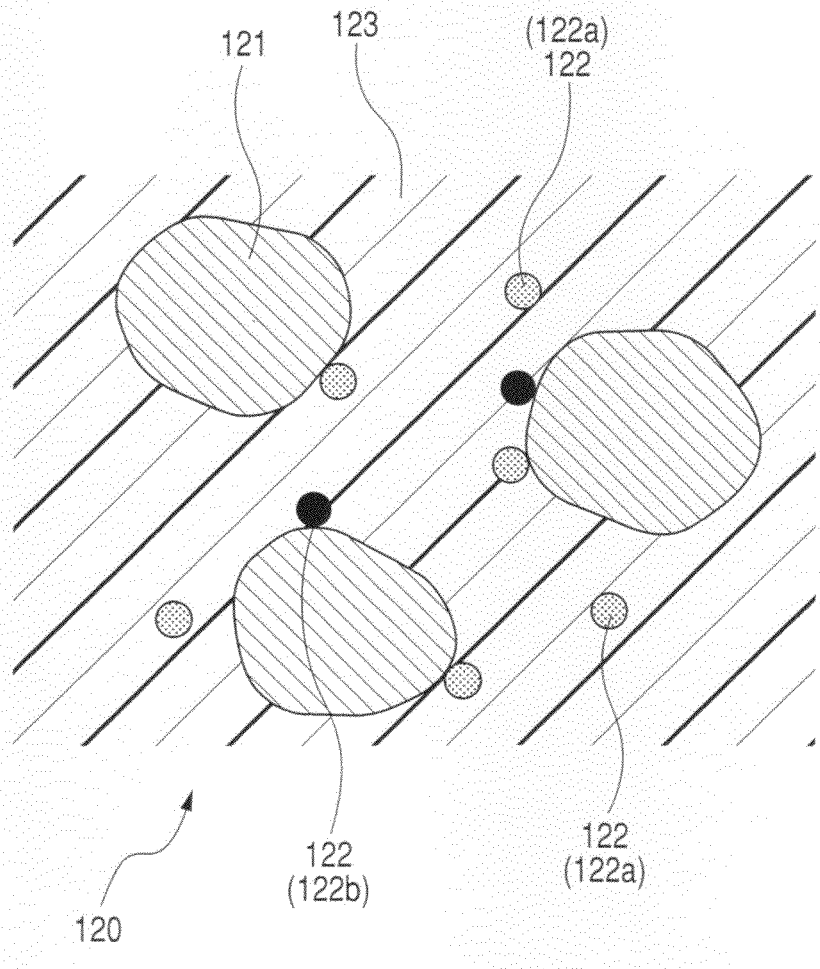
FIG. 3 is a view showing a detailed structure of the core in the reactor according to the first embodiment of the present invention shown in FIG. 1.

FIG. 3 is a view showing a detailed structure of the core 12 in the reactor 1 according to the first embodiment shown in FIG. 1. As shown in FIG. 3, the core 12 is made by solidifying a magnetic-powder resin mixture 120. This magnetic-powder resin mixture 120 is composed of magnetic powder 121 and non-magnetic powder 122, and resin 123.

The non-magnetic powder 122 in the magnetic-powder resin mixture 120 is composed mainly of main component powder 122*a* and low elastic powder 122*b*.

The main component powder 122*a* is composed mainly of one or more types of powder having a heat conductivity which is larger than that of the resin 123.

On the other hand, the low elastic powder 122*b* is composed mainly of one or more types of powder having an elastic modulus which is smaller than that of all types of powder forming the main component powder 122*a*.

In the first embodiment of the present invention, as described later in detail, the main component powder 122*a* is composed of silica powder, and the low elastic powder 122*b* is composed of silicon powder.

A description will now be given of the structure and characteristics of the reactor 1, and a method of producing the reactor 1 according to the first embodiment of the present invention.

The reactor 1 according to the first embodiment of the present invention is assembled to various types of an electric power converter such as a direct current to direct current (DC-DC) converter, and an inverter in order to boost an input voltage thereof.

As shown in FIG. 1, the reactor 1 is comprised of the coil 11, the core 12, and the container 13. The container 13 accommodates the coil 11 and the core 12. For example, the container 13 is made of aluminum which has superior heat discharging characteristics.

As shown in FIG. 1, the container 13 is comprised of a bottom surface 131, a cylindrical side surface (wall) 132, and a radiating pole part 134. The bottom surface 131 has a circular shape. The cylindrical side surface 132 is formed on the bottom surface 131 toward an opening part 133 of the container 13. The radiating pole part 134 is formed on the bottom surface 131 toward the opening part 133 of the container 13. Heat energy generated in the coil 11 when a current flows in the coil 11 is discharged to the outside of the reactor 1 through the radiating pole part 134.

The container 13 is not limited by the structure described above shown in FIG. 1. For example, it is acceptable for the container 13 to have approximately a rectangular prism. The flat type conductive wire 110 is made of copper, for example.

Figure 4A:
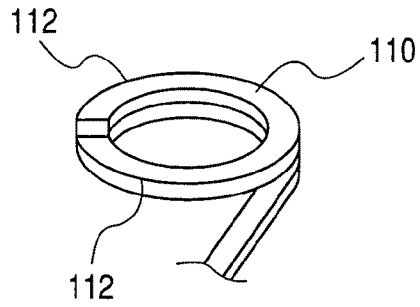
FIG. 4A is a perspective view showing a flat type conductive wire to be used in the method of producing a coil in the reactor according to first embodiment of the present invention.
Figure 4B:
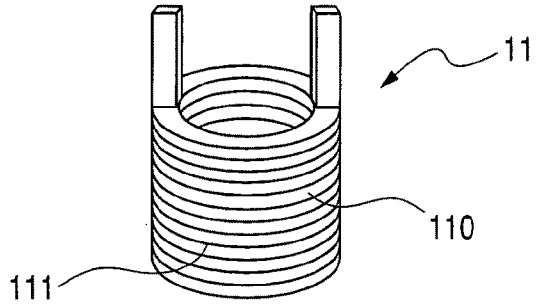
FIG. 4B is a perspective view showing the coil composed of the flat type conductive wire shown in FIG. 4A which is spirally wound.
Figure 4C:
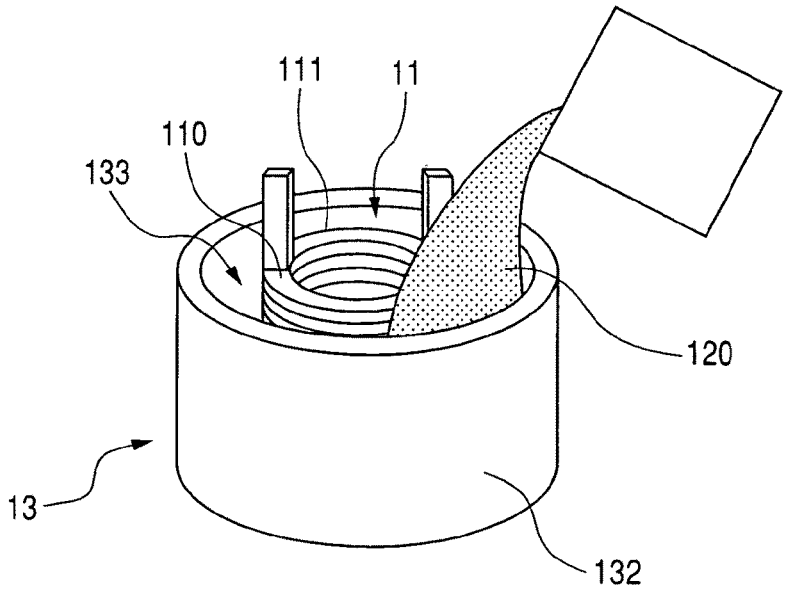
FIG. 4C is a perspective view showing a step of filling a magnetic-powder resin mixture, composed of magnetic power and resin, into a container in which the coil and the core are disposed in the method of producing the reactor according to first embodiment of the present invention.

FIG. 4A is a perspective view showing the flat type conductive wire 110 to be used in the method of producing the coil 11 in the reactor 1 according to the first embodiment of the present invention. FIG. 4B is a perspective view showing the coil 11 composed of the flat type conductive wire 110 shown in FIG. 4A which is spirally wound. FIG. 4C is a perspective view showing a step of filling the magnetic-powder resin mixture 120, composed of magnetic power 121 and resin 123 into the container 13. In the container 13, the coil 11 and the core 12 are disposed in the method of producing the reactor 1 according to the first embodiment of the present invention.

As shown in FIG. 4A, the coil 11 is made of the flat type conductive wire 110 and placed in the container 13 so that the coil 11 surrounds the radiating pole part 134.

For example, the magnetic-powder resin mixture 120 forming the core 12 is composed of the resin 123 such as epoxy resin or thermoplastic resin and the magnetic powder 121 such as ferrite powder, iron powder, or iron silicon alloy powder.

As previously described, the non-magnetic powder 122 in the magnetic-powder resin mixture 120 in the reactor 1 according to the first embodiment contains the main component powder 122*a* and the low elastic powder 122*b*. In particular, the main component powder 122*a* is made of one type of powder, a heat conductivity thereof is higher than that of the resin 123, and a main component of the non-magnetic powder 122. The low elastic powder 122*b* is made of one type of powder, and an elastic modulus thereof is smaller than that of the powder forming the main component powder 122*a*.

In the first embodiment, for example, the main component powder 122*a* is made of silica powder having an average particle size within a range of 0.1 to 100 μm (hereinafter, also referred to as the "silica powder 122*a*"). The low elastic powder 122*b* is made of silicon powder having an average particle size within a range of 0.1 to 100 μm (hereinafter, also referred to as the "silicon powder 122*b*").

Using the silica powder 122*a* having the above particle size and the silicon powder 122*b* having the above particle size make it possible to uniformly disperse the non-magnetic powder 122 into the magnetic powder 121. As a result, the reactor 1 has good magnetic characteristics.

It is possible to use alumina powder, titanium dioxide powder or titanium oxide powder, fused quartz powder, zirconium powder, calcium carbonate powder, aluminum hydroxide powder, silicon nitride powder, glass fiber, or a combination of them, as the main component powder 122*a* instead of using the silica powder.

It is acceptable for the non-magnetic powder 122 to contain unavoidable impurities.

Still further, using a material, as the low elastic powder 122*b*, having a heat conductivity which is approximately the same as that of the main component powder 122*a* allows the reactor 1 to have a superior heat radiating characteristics while maintaining the above functions and effects of the present invention.

Still further, in the first embodiment, the silica powder 122*a* has an elastic modulus of 80 GPa, the silicon powder 122*b* has an elastic modulus of 100 MPa.

Although the elastic modulus of the resin 123 is changeable according to the type of the material thereof, it is possible for the resin 123 to have the elastic modulus within a range of 120 to 250 MPa. The entire core 12 has the elastic modulus within a range of 1 to 35 GPa, specifically, within a range of 3 to 22 MPa.

Figure 7:
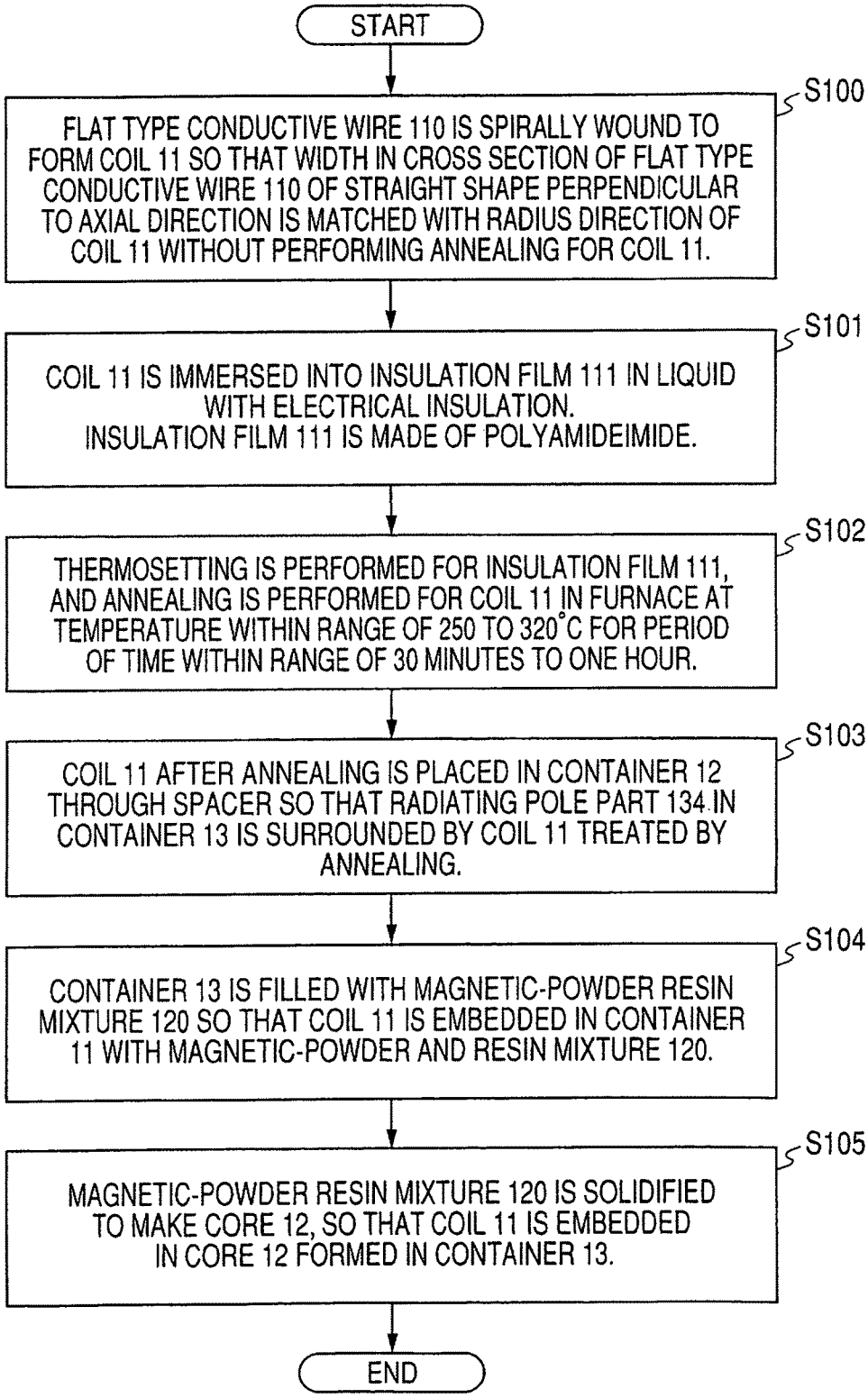
FIG. 7 is a flow chart showing the method of producing the reactor according to the present invention.

A description will now be given of the method of producing the reactor 1 according to the first embodiment with reference to FIG. 4A to FIG. 4C, and FIG. 7. FIG. 7 is a flow chart showing a method of producing the reactor 1 according to the first embodiment.

First, the single flat type conductive wire 110 shown in FIG. 4A is spirally wound edgewise in a concentric configuration in order to form the coil 11 shown in FIG. 4B (step S100 shown in FIG. 7). Specifically, the flat type conductive wire 110 is wound to form the coil 11 so that the width of the cross section of the flat type conductive wire 110 of a straight shape perpendicular to the axial direction is matched with the radial direction of the coil 11. At this time, no annealing for the coil 11 is performed.

The coil 11 before annealing has an elastic modulus within a range of 100 to 130 GPa, and yield strength within a range of 250 to 500 MPa, for example.

Next, the coil 11 is immersed into an insulation film in liquid with electrical insulation (step S101). For example, the insulation film 11 is made of polyamideimide. As shown in FIG. 4B, it is possible to adequately and completely apply the insulation film 111 to the coil 11 when the insulation film 111 has viscosity of not more than 20 Pa·s.

Next, the thermosetting is performed for the insulation film 111. At the same time, the coil 11 is also annealed. For example, the thermosetting of the insulation film 111 and the annealing of the coil 11 are performed in a furnace at a temperature within a range of 250 to 320° C. for a period of time within a range of 30 minutes to one hour (step S102). It is thereby possible for the conductive wire 110 to have elastic modulus within a range of 80 to 100 GPa, and the yield strength within a range of 50 to 100 MPa, for example.

Next, as shown in FIG. 1 and FIG. 2, the coil 11 treated by annealing is placed in the container 12 through the inside of a spacer (omitted from drawings) so that the radiating pole part 134 in the container 13 is surrounded by the coil 11 treated by annealing (step S103).

Before filling the magnetic-powder resin mixture 120 into the inside area and the outer peripheral area of the coil 11 in the container 13, the magnetic-powder resin mixture 120 is prepared in advance. The magnetic-powder resin mixture 120 is composed of the magnetic powder 121, the resin 123, and the non-magnetic powder 122. The non-magnetic powder 122 contains the silica powder 122*a* and the silicon powder 122*b*. The silica powder 122*a* has a heat conductivity which is larger than that of the resin 123. The silicon powder 122*b* has an elastic modulus which is smaller than that of the silica powder 122*a*.

For example, it is formed so that the magnetic-powder resin mixture 120 is composed of the magnetic powder 121 within a range of 91.1 to 92.1 weight %, the resin 123 within a range of 6.7 to 6.8 weight %, and the non-magnetic powder 122 within a range of 1.2 to 1.3 weight %.

In the first embodiment, the magnetic-powder resin mixture 120 is composed of 91.99 weight % of the magnetic powder 121, 6.72 weight % of the resin 123, and 1.29 weight % of the non-magnetic powder 122.

It is possible to uniformly disperse the magnetic powder 121, the non-magnetic powder 122, and the resin 123 in the magnetic-powder resin mixture 120 by satisfying the above ranges in composition. This provides the reactor 1 having good magnetic characteristics and heat conductivity.

Next, the non-magnetic powder 122 will now be explained.

It is possible so that the non-magnetic powder 122 is composed of the silica powder 122*a* within a range of 55.4 to 56.2 weight %, and the silicon powder 122*b* within a range of remaining weight %.

In the first embodiment, the non-magnetic powder 122 is composed of 55.8 weight % of the silica powder 122*a* and remaining weight % of the silicon powder 122*b*.

It is possible to uniformly disperse the magnetic powder 121, the non-magnetic powder 122, and the resin 123 in the magnetic-powder resin mixture 120 by satisfying the above ranges in composition. This provides the reactor 1 having good magnetic characteristics and heat conductivity. Further, this can provide the core 12 of a low elastic modulus.

Next, as shown in FIG. 4C, the container 13 is filled with the magnetic-powder resin mixture 120 having the above composition of magnetic powder and resin so that the coil 11 is embedded in the container 11 and the magnetic-powder resin mixture 120 (step S104).

Next, the magnetic-powder resin mixture 120 is solidified to produce the core 12 (step S105). This makes the reactor 1 in which the coil 11 is embedded in the core 11 in the container 13.

The present invention is not limited by the above-described method of producing the reactor 1. It is possible to perform variable modifications of the method to produce the reactor 1 according to the present invention.

A description will now be given of the functions and effects of the reactor 1 according to the first embodiment of the present invention.

In the reactor 1 according to the first embodiment, the non-magnetic powder 122 is composed of the main component powder 122*a* (silica powder) and the low elastic modulus powder 122*b* (silicon powder). In particular, the main component powder 122*a* (silica powder) has a heat conductivity which is larger than that of the resin 123. The low elastic modulus powder 122*b* (silicon powder) has an elastic modulus which is smaller than that of the main component powder 122*a* (silica powder).

Using the non-magnetic powder 122 containing the mixture of the main component powder 122*a* and the low elastic modulus powder 12*b* can decrease the elastic modulus of the entire non-magnetic powder 122. As a result, this can decrease the elastic modulus of the entire core 12, and can decrease the stress to be applied to the core 12 from the coil 11 even if the coil 11 is thermally expanded when a current flows in the coil 11.

It is thereby possible to provide the reactor 1 capable of suppressing damage of the core 12, and the core 12 from breaking.

Still further, the above structure of the core 12 can decrease its elastic modulus without decreasing the content of the magnetic powder 121 such as ferrite powder, iron powder, or iron silicon alloy powder in the core 12. It is therefore possible to maintain the magnetic characteristics of the reactor 1 while suppressing occurrence of damage to the core 12.

Still further, because the non-magnetic powder 122 has the silica powder 122*a* of the heat conductivity which is greater than that of the resin 123, this makes it possible to adequately keep the heat radiating function of the entire reactor 1. This simultaneously achieves both the function to maintain the magnetic characteristics of the reactor 1 and the function to keep the heat radiation in the reactor 1.

Moreover, the core 12 in the reactor 1 according to the first embodiment uses the main component powder 122*a* made of the silica powder. Using the silica powder 122*a* of the heat conductivity which is sufficiently greater than that of the resin 123 can adequately improve the heat discharging function of the entire core 12.

Further, because the silica powder 122*a* is easily available on the commercial market at a low price, it is possible to produce the reactor 1 having those superior functions and effects at a low manufacturing cost.

In the reactor 1 according to the first embodiment, the low elastic powder 122*b* is made of silicon powder. The silicon powder 122*b* is non-magnetic powder having a low elastic modulus, and is available on the commercial market at a low price. It is thereby possible to produce the reactor 1 having the superior functions and effects previously described at a low manufacturing cost.

The coil 11 has the elastic modulus within a range of 80 to 100 GPa. The entire core 12 has the elastic modulus of not more than 22 GPa. It is therefore possible to decrease the elastic modulus of the core 12 while increasing the elastic modulus of the coil 11. This allows the stress generated in the core 12 to be more decreased, and more suppresses the damage to the core 12.

In the manufacturing of the reactor 1 according to the first embodiment, because the non-magnetic powder 122 contains the powder 122*b* having a low elastic modulus, this can adequately decrease the elastic modulus of the entire core 12 without decreasing the content of the silica powder 122*a* in the core 12.

Still further, because coil 11 is annealed before the magnetic-powder resin mixture 120 is placed in the inside area and the outer peripheral area of the coil 11 in the container 13, it is possible to provide the reactor 1 capable of more suppressing the damage of the core 12, and the core 12 from breaking.

Still further, because the above annealing of the coil 11 and the hardening of the insulation film 111 are simultaneously performed after the insulation film 111 in liquid with electrical insulation is applied to the coil 11, it is possible to decrease the stress to the inside of the core 12, and to decrease the number of steps of the fabrication of the reactor 1. That is, according to the first embodiment, before the annealing is performed for both the hardening to the insulation film 111 and the annealing to the coil 11 after immersing the coil 11 into the insulation film 111 in liquid with electric insulation, it is not necessary to separately perform the hardening and annealing for the coil 11, and possible to decrease the number of the steps in the fabrication of the reactor 1.

Still further, because the flat type conductive wire 110 is made of copper, it is possible to efficiently suppress damage to the core 12. That is, when the flat type conductive wire 110 is made of copper, a large heat expansion occurs by heat energy generated in the copper. When the structure of the reactor 1 according to the first embodiment of the present invention previously described is applied to the reactor 1 having the conductive wire made of copper, it is possible to adequately decrease the stress to be applied to the core 12 from the coil 11 when a current flows into the coil 11.

Still further, because the coil 11 is made of the single flat type conductive wire 110 spirally wound edgewise, it is possible to obtain the functions and effects of the present invention. That is, when the coil 11 is spirally wound edgewise, a part at the outer peripheral side of the coil 11 in the radius direction in the conductive wire 110 is partially hardened. Annealing the coil 11 made of the conductive wire 110 spirally wound edgewise can decrease the elastic modulus and stress at the part of the conductive wire 110 which is easily hardened, it is thereby possible to efficiently obtain the functions and effects of the present invention.

As described above in detail, according to the first embodiment, it is possible to provide the reactor 1 capable of suppressing damage to the core, and the method of producing the reactor 1.

Second Embodiment

A description will be given of the second embodiment of the present invention with reference to FIG. 5 and FIG. 6.

Figure 5:
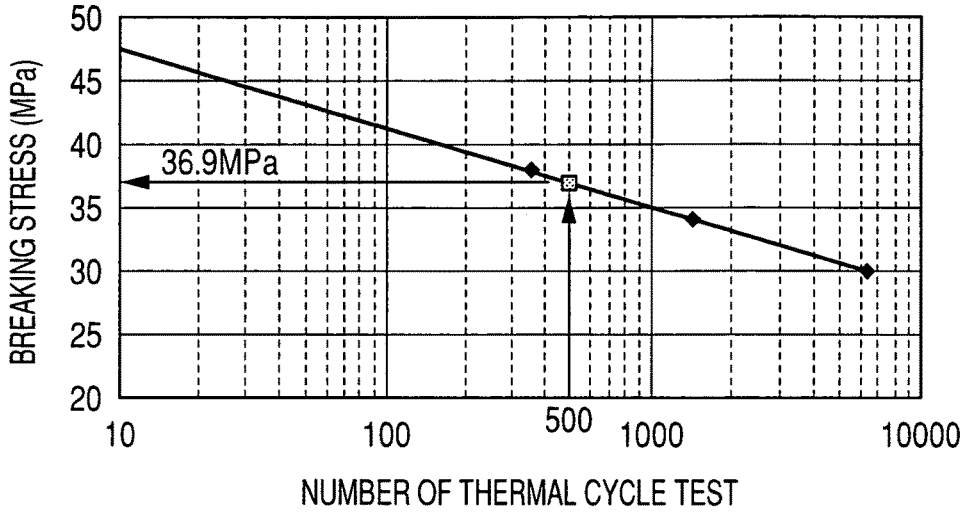
FIG. 5 is a graph showing a relationship between a breaking stress to be applied to the core and the number of thermal cycle tests of the reactor according to a second embodiment of the present invention.

FIG. 5 is a graph showing a relationship between a breaking stress to be applied to the core 12 and the number of thermal cycle tests of the reactor 1 according to the second embodiment of the present invention. FIG. 6 is a graph showing a relationship between a generated stress in the core 12 and the elastic modulus of the core 12 in the reactor 1 according to the second embodiment of the present invention.

The second embodiment shows the relationship between a stress and an elastic modulus of the core in test samples (various types of reactors) as the results of thermal cycle tests.

In the second embodiment, various types of reactors as test samples having a different elastic modulus were prepared. Those test samples were cooled to minus 40 degrees (−40° C.), and heated to 150 degrees (150° C.). The above cycle (as thermal cycle test) of cooling and heating the test samples was repeated multiple times, for example, 500 times.

After completion of 500 times of the thermal cycle tests, a breaking stress of the core in each of the test samples was detected, while the stress from the coil to the core was gradually increased. Further, a necessary magnitude of the elastic modulus of the core which does not reach its breaking stress was detected.

The second embodiment shows the results of the thermal cycle test when the elastic modulus of the coil in each of the test samples was 90 GPa which was in a preferable range of 80 to 100 GPa for the coil.

Figure 6:
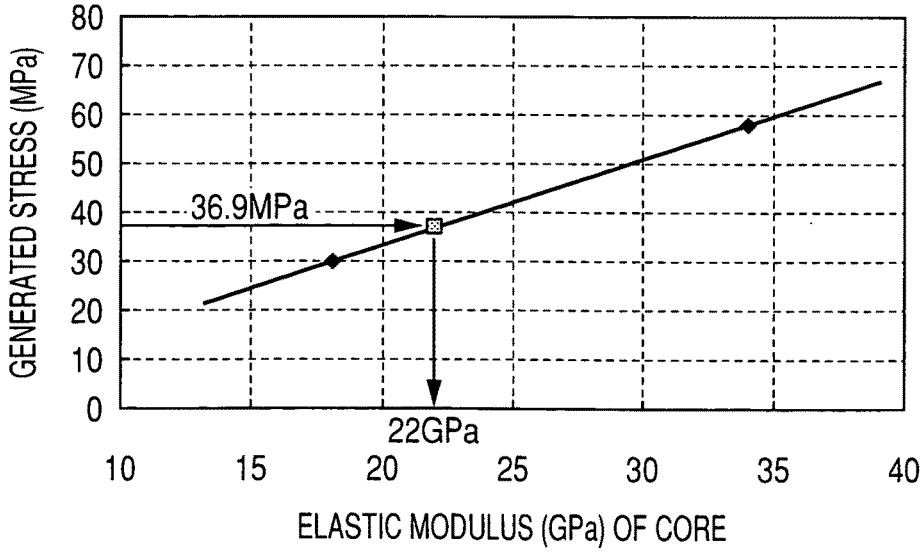
FIG. 6 is a graph showing a relationship between a generated stress in the core and an elastic modulus of the core in the reactor according to the second embodiment of the present invention.

FIG. 5 and FIG. 6 show the results of the thermal cycle tests. As clearly understood from the results shown in FIG. 5, the breaking stress of the core becomes 36.9 MPa after completion of the thermal cycle test of 500 times. Further, as can be understood from the results shown in FIG. 6, it is necessary to have the elastic modulus of the core of not more than 22 GPa in order to prevent the stress of not less than 36.9 MPa (breaking stress) from being generated.

As the above results of the thermal cycle tests in the second embodiment, it can be understood that the stress to be applied to the core from the coil can be decreased, and the stress does not reach the breaking stress of the core when the core in a reactor has the elastic modulus of not more than 22 GPa.

The second embodiment described above uses the reactors as the test samples having the coil of a constant elastic modulus, 90 GPa elastic modulus. It is possible for a reactor to obtain the above same effects unless the coil in the reactor has the elastic modulus within a range of 80 to 100 GPa.

(Other Features and Effects of the Present Invention)

It is possible to apply the reactor according to the present invention to electric power conversion devices such as a DC-DC converter and an inverter. In the method of producing the reactor, it is possible to use thermosetting resin or thermoplastic resin such as epoxy resin.

It is also possible to use ferrite powder, or iron silicon alloy powder as the magnetic powder.

Through the description of the present invention, the main component powder in the non-magnetic powder is made of one type of powder and excess 50 wt. % of the entire non-magnetic powder. In addition, it is also acceptable that the main component is made of more than two types of powders, and excess 50 wt. % of the entire non-magnetic powder.

It is possible to use, as the main component powder, silica powder, alumina powder, titanium dioxide powder or titanium oxide powder, fused quartz powder, zirconium powder, calcium carbonate powder, aluminum hydroxide powder, silicon nitride powder, glass fiber, or a combination of them.

In the reactor as another aspect of the present invention, it is preferred that the main component powder contains at least silica powder. In this case, because the silica powder has a heat conductivity which is adequately larger than that of the resin, it is possible to adequately increase the heat radiation function of the core. In addition, because the silica powder can be easily available on the commercial market at a low price, it is possible to produce the reactor having those superior functions and effects at a low manufacturing cost.

In the reactor as another aspect of the present invention, it is preferred that the low elastic modulus powder contains at least silicon powder. Because silica powder generally has a low elastic modulus, and is available on the commercial market at a low price. Accordingly, using the silica powder as a low elastic modulus can provide the reactor having those superior functions and effects at a low manufacturing cost.

In the reactor as another aspect of the present invention, it is preferred that the coil has an elastic modulus within a range of 80 to 100 GPa, and the entire core has an elastic modulus of not more than 22 GPa. Because this structure of the reactor increases the elastic modulus of the coil, and decreases the elastic modulus of the core, it is possible to further decrease the stress generated in the coil and to be applied to the core. This can further suppress the core from damaging and breaking.

It is preferred for the core to have the elastic modulus of not less than 3 GPa. When the elastic modulus of the core is less than 3 GPa, the magnetic powder vibrates in the core when a current flows into the coil, and as a result, this makes it impossible to adequately suppress vibration generated in the entire reactor.

In the method of producing a reactor as another aspect of the present invention, the coil is annealed before filling the magnetic-powder resin mixture into the inside area and the outer peripheral area of the coil placed in the container.

This step can produce the reactor capable of further suppressing the core from damage. That is, a conventional method embeds a coil obtained by a wound conductive wire into magnetic-powder resin mixture without annealing it. The wound conductive wire without annealing becomes hard and has an improved strength characteristics. The conventional technique has considered that it is preferable in structure for the reactor to have the core of an improved strength. However, when the coil is thermally expanded by flowing a current in the coil, the thermally expanded coil generates a stress. The stress is then applied to the core. As a result, damage occurs in the coil, and the core breaks.

On the other hand, the method according to the present invention performs the annealing of the coil before the coil is placed in the container. The coil in the container is filled with the magnetic-powder resin mixture in order to form the core in the inside area and outer peripheral area of the coil. In other words, the coil is embedded in the core placed in the container. This can decrease the stress generated in the coil when a current flows in the coil, and to be applied to the core without drastically changing the material characteristics of the conductive wire forming the coil. That is, performing the annealing of the coil can decrease the elastic modulus of the conductive wire of the coil (because of increasing the elastic modulus of the coil by spirally winding the conductive wire), and decrease the durability of the conductive wire. Accordingly, it is possible to decrease the stress applied from the coil to the core by both the effect of decreasing the elastic modulus of the core previously described and the effect of decreasing the elastic modulus of the conductive wire of the coil even if the coil is thermally expanded when a current flows in the coil.

In the method as another aspect of the present invention, after an insulation film in liquid with electrical insulation is applied onto the coil, the annealing of the coil and the hardening of the insulation film applied on the coil are simultaneously performed. This can decrease the stress from the coil to the inside of the core, and further decreases the total number of production steps of the reactor. That is, according to the present invention, the annealing of the coil and the hardening of the insulation film applied on the coil are simultaneously performed after the coil is immersed into an insulation film in liquid with electrical insulation properties. This can decrease the total number of the production steps to produce the reactor according to the present invention when compared with that of a conventional production steps in which the annealing and hardening are separately performed.

In the method as another aspect of the present invention, the conductive wire is made of copper or aluminum. This structure can effectively suppress the core from being damaged. That is, when the conductive wire is made of copper or aluminum, the coil is markedly expanded by heat generated when a current flows in the coil. When the method according to the present invention is applied to the production of a reactor having a conductive wire made of copper or aluminum, it is possible to adequately decrease the magnitude of the stress applied from the coil to the core.

In the method as another aspect of the present invention, the method uses the coil of a flat type conductive wire treated by an edgewise winding processing. This step can show the effect of the functions and effects of the present invention. That is, an outside part of the conductive wire observed from the diameter direction of the coil becomes hard when the conductive wire is treated by the edgewise process. Therefore annealing the coil treated by the edgewise process can decrease the elastic modulus and durability of the outside part of the coil. Using this step can effectively show the functions and effects of the present invention.

While specific embodiments of the present invention have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention which is to be given the full breadth of the following claims and all equivalents thereof.

What is claimed is:

1. A reactor comprising:

a coil composed of a spirally-wound conductive wire, and generating magnetic field when a current flows in the coil; and a core placed in an inside area and the outer peripheral area of the coil in a container in which the coil and the core are placed, wherein the core is solidified and made of a magnetic-powder resin mixture composed of magnetic powder, non-magnetic powder, and resin, the non-magnetic powder is composed of main component powder and a low elastic modulus powder, the main component powder, as a main component of the non-magnetic powder, being made of one or more kinds of powder of a heat conductivity which is larger than that of the resin, and the low elastic modulus powder is made of one or more kinds of powder of an elastic modulus which is smaller than that of the main component powder, a quantity of the main component powder having an elastic modulus, which is larger than an elastic modulus of the low elastic modulus powder, is larger than a quantity of the low elastic modulus powder, and a mixture of the main component powder, the resin, the magnetic powder and the low elastic modulus powder is place in the inside area and the outer peripheral area of the coil in the container.

2. The reactor according to claim 1, wherein the main component powder is silica powder, and the low elastic modulus powder is made of silicon powder.

3. The reactor according to claim 2, wherein the non-magnetic powder contains silica powder or not less than 50% and silicon powder of a remaining percentage.

4. The reactor according to claim 1, wherein the main component powder contains at least silica powder, and the low elastic modulus powder contains at least silicon powder.

5. The reactor according to claim 1, wherein the main component powder contains at least silica powder of not less than 50 wt. % to the entire of the non-magnetic powder.

6. The reactor according to claim 1, wherein the coil has an elastic modulus within a range of 80 to 100 GPA, and an entire elastic modulus of the core is not more than 22 GPa.

* * * * *